US006314977B1

(12) United States Patent
Obitts et al.

(10) Patent No.: US 6,314,977 B1
(45) Date of Patent: Nov. 13, 2001

(54) ADJUSTABLE HEIGHT HANDGRIP FOR A CRUTCH

(75) Inventors: Shane Obitts, Elyria; Paul C. Gilles, Amherst; Kevin S. Wysocki, Elyria, all of OH (US)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 09/390,151

(22) Filed: Sep. 3, 1999

(51) Int. Cl.[7] ..... A61H 3/02
(52) U.S. Cl. ..... 135/68
(58) Field of Search ..... 135/68, 69, 72, 135/76

(56) References Cited

U.S. PATENT DOCUMENTS

| | | | | |
|---|---|---|---|---|
| 885,339 | * | 4/1908 | Hargrove | 135/72 |
| 1,073,991 | * | 9/1913 | Jones | 135/69 |
| 1,505,081 | * | 8/1924 | Arndt | 135/68 |
| 2,172,047 | | 9/1939 | Jacobucci . | |
| 2,669,244 | * | 2/1954 | Greene et al. | 135/72 |
| 4,476,885 | * | 10/1984 | Stein | 135/69 |
| 4,509,741 | | 4/1985 | Smith . | |
| 4,979,533 | | 12/1990 | Hansen et al. . | |
| 5,291,910 | | 3/1994 | Bui et al. . | |
| 5,402,811 | * | 4/1995 | Weng | 135/68 |
| 5,605,170 | * | 2/1997 | Weng | 135/68 |
| 5,791,360 | * | 8/1998 | Battiston et al. | 135/68 |

FOREIGN PATENT DOCUMENTS

| | | |
|---|---|---|
| 95/13783 | 5/1995 | (WO) . |

* cited by examiner

*Primary Examiner*—Alvin Chin-Shue
*Assistant Examiner*—Sarah Purol
(74) *Attorney, Agent, or Firm*—Hudak & Shunk Co., L.P.A.

(57) ABSTRACT

An orthopedic crutch is provided which has a parallel vertical support members which oppose a central longitudinal axis of the crutch. The support member include apertures on the opposing surfaces to form parallel pairs of apertures. An adjustable hand crutch includes a locking member which engages the aperture for each vertical support. The handgrip further has a support terminating in the collar on either side which encircles the corresponding vertical support. A yoke member cooperates with the inner portion of the collar relative to the longitudinal central axis of the crutch. The yoke member can be slid inwardly to disengage the locking element from the pairs of apertures. The locking member is retained in the retracted position until the next aperture is encountered.

18 Claims, 3 Drawing Sheets

ADJUSTABLE HEIGHT HANDGRIP FOR A CRUTCH

FIELD OF THE INVENTION

The invention relates generally to orthopedic crutches, and more particularly to a crutch having an adjustable height hand grip.

BACKGROUND OF THE INVENTION

Orthopedic crutches are used to help stabilize a user. In general a crutch includes an arm support which is meant to fit at the under arm of a user and extends to terminal portion which rests against the floor. Usually the crutch includes a wishbone section which flares somewhere between a quarter and half way up the crutch height to provide a broader section, which accommodates a handgrip. A hand grip may be used to help bear the weight of the user, and may be mounted for example by a pin extending from one side vertical support to a second side vertical support. In the past, adjustability has been provided for crutches, by wing nuts, for example, which are unscrewed from the pin so that the pin may be readjusted into a different level of opening in the side vertical supports.

SUMMARY OF INVENTION

In accordance with the invention, an orthopedic crutch is provided which has a pair of spaced-apart generally parallel vertical, and preferably tubular vertical supports attached at a open upper end to an arm support, and converging together at a lower end for attachment to a single tubular leg and foot.

Each of the vertical supports has a plurality of spaced-apart pairs of apertures in the longitudinal inner surface; i.e. the apertures at least open toward each other and may extend all the way through the tubular vertical supports. A handgrip is provided which is easily adjustable and which self engages the next available hole in order to simplify adjustment of the crutch member.

In particular in accordance with the invention, an adjustable hand support is provided, which extends between the two vertical support members. This support preferably includes a handgrip which provides for cushioning of the users hand as well as a surface which is easily engaged. On either end, the support includes a circular or semi-circular collar, which at least partially surrounds the support member. More preferably, the collar totally surrounds the circular member in order to avoid bowing of the vertical supports.

Each side of the support member includes a slidable yoke member having a sleeve which surrounds the horizontal part of the support and which extends over the inner portion of the collar so as to augment the collar's contact with the inner longitudinal surface of the vertical support. The yoke includes an inner protrusion which activates a steel detent pin. The pin extends through a hole in the collar to engage a notch of the steel pin enclosed in the center of the support. The pin engages one of the holes on the vertical support and thereby lock the handgrip in a desired height position. The detent pin is spring loaded into an outward position so as to engage the hole. The detent can be withdrawn from the locked position by means of thumb prints on the collar which are pushed inward (i.e. toward the longitudinal axis of the crutch) in order to disengage the detent pin from the hole. Once the pin is disengaged from the aperture, the outer surface of the longitudinal member will keep the collar in a retracted position until the next available hole is hit. At this position, the collar snaps back into the outward position and the pin locks the handgrip into the desired hand position. In order to facilitate the cooperation between the collar and the yoke member, the collar includes a flattened guide way which is engaged by opposing legs of the yoke member to provide a track way for the retraction of the yoke member.

DETAILED DESCRIPTION OF THE DRAWINGS

Figure 1:
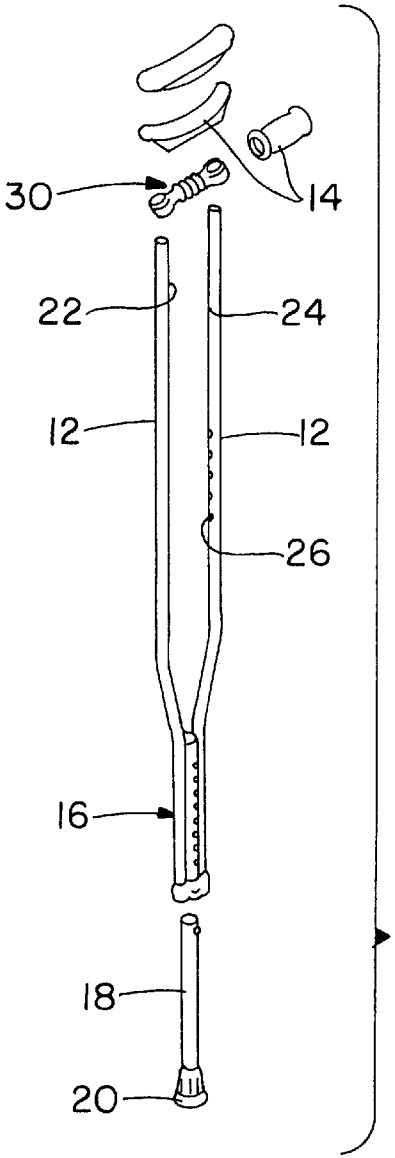
FIG. 1 is an illustration of a crutch in accordance with the invention.

A first embodiment of the orthopedic crutch in accordance with the invention is shown in FIG. 1. In this embodiment the orthopedic crutch comprises a pair of generally parallel vertical supports 12 connected at the top to an arm support 14 having a convergence section 16 which are attached to a leg section 18 (to form a wishbone shape) and having a terminal high friction cushioning foot 20. The vertical support frames 12, and leg 18, are generally preferably rigid and tubular, such as metal, or maybe wooden or plastic. The opposing longitudinal surfaces 22, 24 of the vertical supports 12 include spaced parallel pairs of apertures which are engaged on either side by detent pins which are biased outwardly within the handgrip 30.

Figure 4:
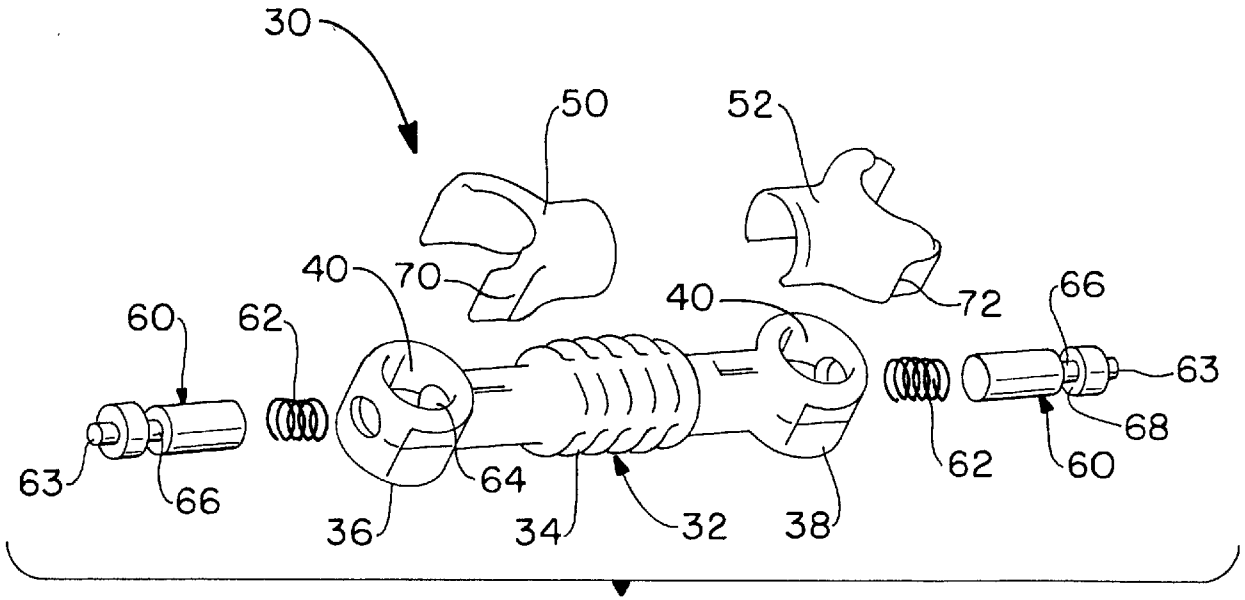
FIG. 4 is an exploded drawing of the components of the handgrip in accordance with the present invention.
Figure 2:
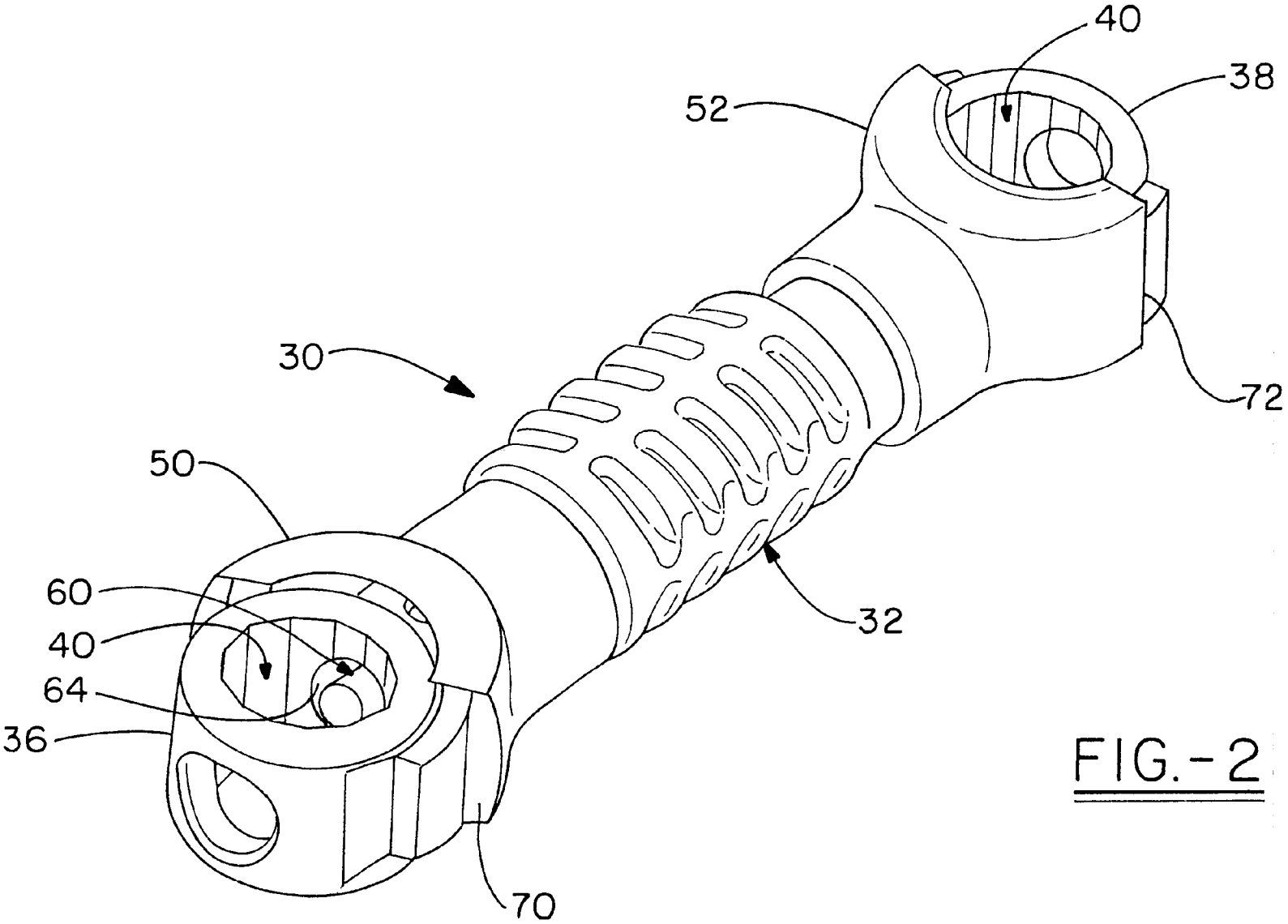
FIG. 2 is a top perspective of the handgrip in accordance with the invention.

A first embodiment of the handgrip 30 is shown in FIGS. 2 and 4. The handgrip comprises a support member 32, which has a central ribbed handhold section 34. The handhold section 34 has the desired characteristics for providing a good grip and feel. The support 32 also includes on either end a pair of collars 36, 38. The collars include an inner surface 40 intended to mate with the longitudinal sides 22 and 24 respectively of the vertical supports. In addition, preferably the collars include an outer circle portion 42 which contacts the external longitudinal surface of the vertical supports.

On either side a yoke member 50, 52 includes a sleeve 54 which encircles a portion of the support member 32. The yoke terminates in a U-shaped frame, which cooperates with the collar member 36 and 38 to engage the inner surfaces 22 and 24 of the vertical supports.

Further, the yoke members 50 and 52 each have a locking means such as a detent member 6 which may be integral with the collar, or as shown in FIG. 4, separate from but activated by the yoke member. In particular, the yoke has detent members 60 are biased outwardly such as by springs 62 captured in an opening 64 on the inner portion of the support member 32.

In particular, the detent pins 60 each include a reduced diameter portion 66 presenting a shoulder 68 that is engaged by a lip or protrusion on the yoke members 50 and 52. As the yoke members 50 and 52 are retracted in a inward direction, the protrusion rides against the shoulder 68 so that the pins 60 are disengaged from the pairs of apertures 26. The longitudinal inner surface of the vertical support 22 and 24 accordingly hold the pin in a disengaged position until the next pair of apertures is encountered. At this point, the pins 60 snap back into place.

The collar members 50 and 52 also include thumb prints 70 and 72 to facilitate the inward retraction of the yoke members. In a preferred embodiment, the collar members 36, 38 include slide ways 76 which are engaged by leg portions of the yokes 50 and 52 to hold the yoke members in position during retraction of the yoke members.

Figure 3:
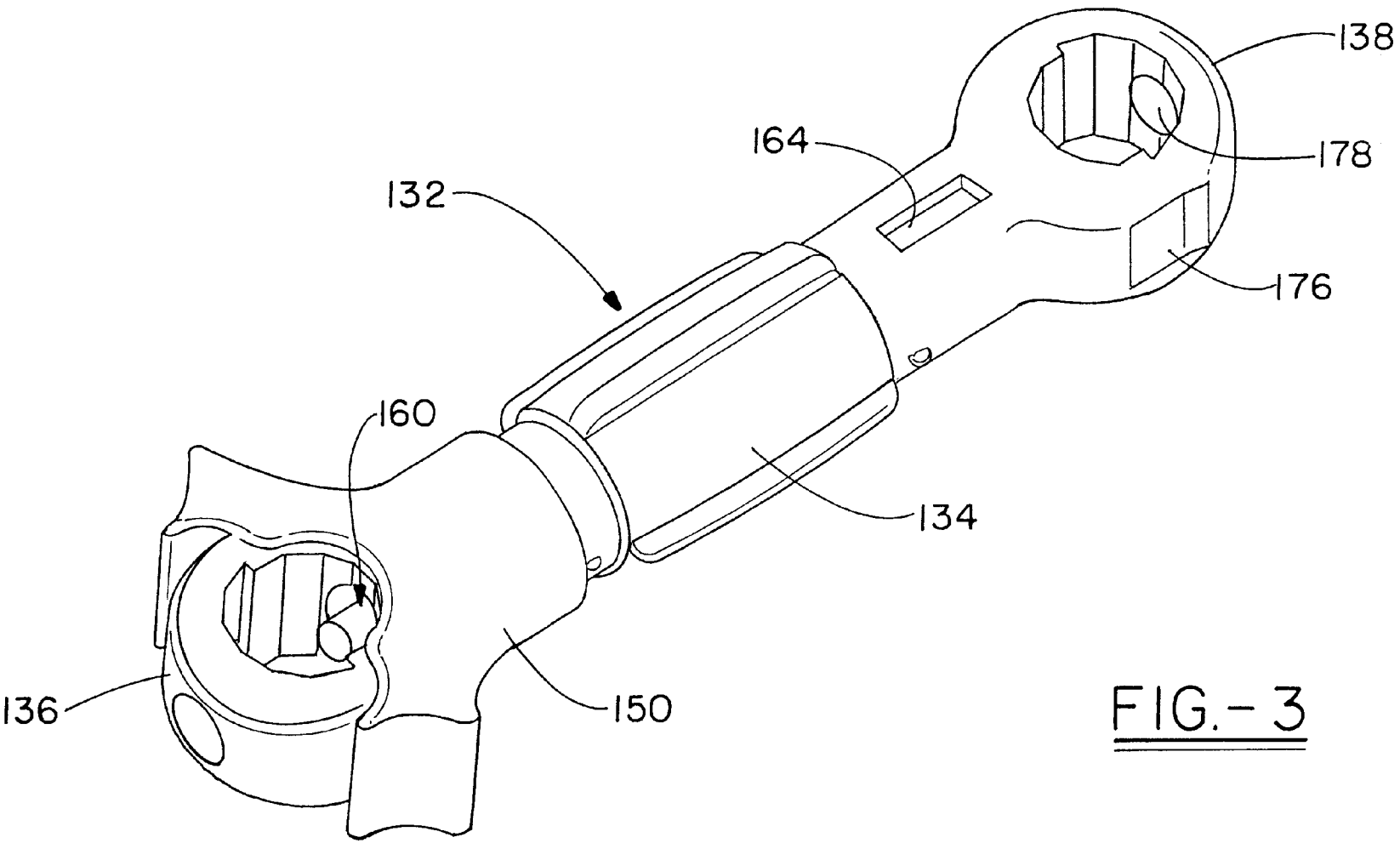
FIG. 3 is a drawing of an alternative embodiment of the hand grip of the present invention with one of the yoke members removed and a different hand grip.

An alternative embodiment of the handgrip in accordance with the invention is shown in FIG. 3. Support member 132 includes a handgrip portion 134. Support 132 terminates on either side in collar members 136 and 138. In this embodiment the invention is shown with only one yoke member 150 in place but including the pin member 160 which extends in an outward direction to engage an aperture in the longitudinal side of the vertical support. The guide way 176 can be seen in the opposing collar member 138 and an exterior opening in the collar 178 can be seen to provide for access to the spring opening 164.

While in accordance with the patent statutes, the best mode and preferred embodiment have been set forth, the scope of the invention is not limited thereto, but rather by the scope of the attached claims.

What is claimed is:

1. An orthopedic crutch comprising:

two substantially vertical support members having opposing pairs of apertures which are opened to a central longitudinal axis of the orthopedic crutch; and an adjustable hand support comprising a support member having a collar which at least partially surrounds a said vertical support member at a surface surrounding at least one of said apertures, and a yoke member which slidably cooperates with said support member and engages said collar, said hand support further comprising a pair of locking members which extend and are biased outwardly from said central longitudinal axis, said locking members being retractable by being retractable in an inward position.

2. An orthopedic crutch as set forth in claim 1, wherein said locking member comprises a detent pin.

3. An orthopedic crutch as set forth in claim 2, wherein said detent pin cooperates with said yoke and can be contracted inwardly by drawing said yoke in toward said central longitudinal axis relative to said collar.

4. An orthopedic crutch as set forth in claim 3, wherein said collar portions entirely encircle said orthopedic supports.

5. An orthopedic crutch as set forth in claim 4, wherein said collar supports include an opening which houses said detent pin.

6. An orthopedic crutch as set forth in claim 5, wherein said opening further houses a spring which biases said detent pin outwardly.

7. An orthopedic crutch as set forth in claim 1, wherein said collar further includes a guide way for said yoke.

8. An orthopedic crutch as set forth in claim 7, wherein said collar further includes a thumb print to enable retraction of said yoke in said guide way.

9. An adjustable handle for use with an orthopedic crutch, comprising:

two parallel vertical support members connected at the top by an arm support, said vertical support members having opposed longitudinal surfaces which face each other and a central longitudinal axis of said crutch member and further including pairs of spaced opposed openings, said handle extending longitudinally to have a first terminal end with a collar which circumferentially surrounds one of said vertical support members and which has a detent opening, and a yoke on said handle which cooperates with said collar, said handle further including a first outwardly biased locking member which extends through said detent opening in order to be capable of engaging one of a pair of said openings and a second terminal end with a collar which circumferentially surrounds the other of said vertical supports and which has a detent opening, said handle further including a second outwardly biased locking member which extends through said detent opening in order to be capable of engaging a second pair of said openings.

10. An adjustable handle for use with an orthopedic crutch as set forth in claim 9, wherein said detent pin cooperates with said yoke and can be contracted inwardly by drawing said yoke in toward said central longitudinal axis relative to said collar.

11. An adjustable handle for use with an orthopedic crutch as set forth in claim 10, wherein said first and said second terminal end each include a collar and a yoke and at either end, said detent pin cooperates with said yoke and can be contracted inwardly by drawing said yoke in toward said central longitudinal axis relative to said collar.

12. An adjustable handle for use with an orthopedic crutch as set forth in claim 11, wherein said collar entirely encircle said orthopedic support.

13. An adjustable handle for use with an orthopedic crutch as set forth in claim 12, wherein said collars each include an opening which houses said detent pin.

14. An adjustable handle for use with an orthopedic crutch as set forth in claim 13, wherein said opening further houses a spring which biases said detent pin outwardly.

15. An adjustable handle for use with an orthopedic crutch as set forth in claim 14, wherein each of said collars further include a hole diametrically opposing said opening to enable said pin to be mounted in said opening.

16. An adjustable handle for use with an orthopedic crutch as set forth in claim 15, wherein said collar further includes a guide way for said yoke.

17. An orthopedic crutch as set forth in claim 6, wherein said yokes each have a pair of legs having an inner surface which at least partially surround the vertical support and each of said legs having an outer surface having a shoulder which enables a user to disengage the detent.

18. An orthopedic crutch as set forth in claim 16, wherein said yokes each have a pair of legs having an inner surface which at least partially surround the vertical support and each of said legs having an outer surface having a shoulder which enables a user to disengage the detent.

* * * * *